US012172857B2

(12) United States Patent
Ogawa et al.

(10) Patent No.: US 12,172,857 B2
(45) Date of Patent: Dec. 24, 2024

(54) MEDIUM TRANSPORT APPARATUS AND RECORDING APPARATUS

(71) Applicant: SEIKO EPSON CORPORATION, Tokyo (JP)

(72) Inventors: Masashi Ogawa, Shiojiri (JP); Ryoichi Morisawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 149 days.

(21) Appl. No.: 18/047,217

(22) Filed: Oct. 17, 2022

(65) Prior Publication Data

US 2023/0124719 A1 Apr. 20, 2023

(30) Foreign Application Priority Data

Oct. 18, 2021 (JP) ..... 2021-170106

(51) Int. Cl.
*B65H 29/60* (2006.01)

(52) U.S. Cl.
CPC ..... *B65H 29/60* (2013.01); *B65H 2402/441* (2013.01); *B65H 2601/11* (2013.01); *B65H 2601/325* (2013.01)

(58) Field of Classification Search
CPC ..... B41J 11/006; B65H 5/36; B65H 29/60; B65H 85/00; B65H 2301/3124; B65H 2402/31; B65H 2402/45; B65H 2402/441; B65H 2404/6111; B65H 2404/612; B65H 2404/632; B65H 2601/11; B65H 2601/325; B65H 2801/06
USPC ..... 399/124
See application file for complete search history.

(56) References Cited

U.S. PATENT DOCUMENTS

| | | | | |
|---|---|---|---|---|
| 7,784,786 | B2 * | 8/2010 | Tashiro | B65H 5/062 271/264 |
| 8,864,124 | B2 * | 10/2014 | Yamamoto | B65H 3/44 271/9.13 |
| 8,989,651 | B2 * | 3/2015 | Mori | G03G 21/1638 399/401 |
| 11,099,514 | B2 * | 8/2021 | Kamikawa | G03G 21/1633 |
| 11,535,467 | B2 * | 12/2022 | Nishii | B65H 1/20 |
| 11,548,749 | B2 * | 1/2023 | Ikegami | B65H 5/26 |

FOREIGN PATENT DOCUMENTS

JP 2017-062333 A 3/2017

* cited by examiner

*Primary Examiner* — Leslie A Nicholson, III
(74) *Attorney, Agent, or Firm* — WORKMAN NYDEGGER

(57) ABSTRACT

A medium transport apparatus includes a first and a second transport path, a third transport path formed the first transport path and the second transport path merging at a merging point, a door that is displaceable between a closed state in which the door forms at least a portion of the first transport path and an opened state in which at least a portion of the first transport path is opened, and a switching section that is arranged at the merging point and that is, while the door is in the closed state, displaceable between a first state in which the second transport path is opened and a second state in which the first transport path is opened, wherein when the door is in the opened state, the switching section is displaced to a third state in which at least a portion of the second transport path is opened.

13 Claims, 8 Drawing Sheets

MEDIUM TRANSPORT APPARATUS AND RECORDING APPARATUS

The present application is based on, and claims priority from JP Application Serial Number 2021-170106, filed Oct. 18, 2021, the disclosure of which is hereby incorporated by reference herein in its entirety.

BACKGROUND

1. Technical Field

The present disclosure relates to a medium transport apparatus and a recording apparatus.

2. Related Art

In the related art, medium transport apparatuses having various configurations have been used, such as recording apparatuses represented by printers. Among these, there is a medium transport apparatus including a plurality of medium transport paths. For example, JP-A 2017-62333 discloses an image forming apparatus having a first transport path and a second transport path and also having an intermediate guide at a merging portion of the first transport path and the second transport path.

However, in such a medium transport apparatus including a plurality of medium transport paths, it may be difficult to easily remove a medium that has failed to be transported in a transport path. For example, in the image forming apparatus of JP-A 2017-62333, when the medium transport failure occurs in a transport path, an operator has to hold a grip portion provided on an intermediate guide and pivot the intermediate guide while holding the grip portion to open the transport path, thereby complicating the work of removing the medium for the operator.

SUMMARY

A medium transport apparatus according to an aspect of the present disclosure includes a transport path that transports a medium and the transport path has a first transport path, a second transport path, and a third transport path formed the first transport path and the second transport path merging at a merging point, a door that is displaceable between a closed state in which the door forms at least a portion of the first transport path and an opened state in which at least a portion of the first transport path is opened, and a switching section that is arranged at the merging point and that is, while the door is in the closed state, displaceable between a first state in which the second transport path is opened and a second state in which the first transport path is opened, wherein when the door is in the opened state, the switching section is displaced to a third state in which at least a portion of the second transport path is opened.

DESCRIPTION OF EMBODIMENTS

Figure 1:
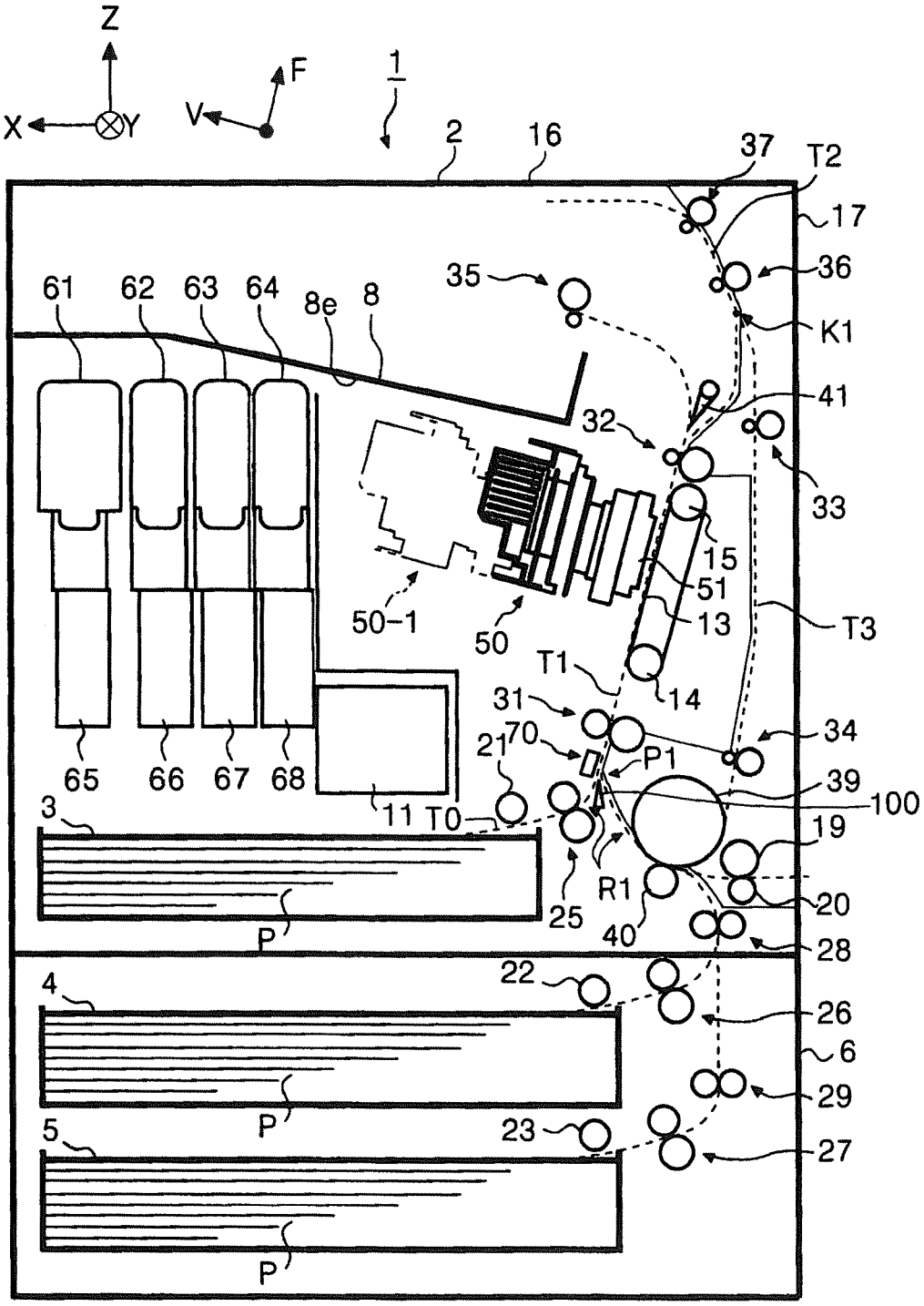
FIG. 1 shows internal configuration of a printer according to an embodiment of the present disclosure.

The following is a schematic description of this disclosure.

A medium transport apparatus according to a first aspect includes a transport path that transports a medium and the transport path has a first transport path, a second transport path, and a third transport path formed the first transport path and the second transport path merging at a merging point, a door that is displaceable between a closed state in which the door forms at least a portion of the first transport path and an opened state in which at least a portion of the first transport path is opened, and a switching section that is arranged at the merging point and that is, while the door is in the closed state, displaceable between a first state in which the second transport path is opened and a second state in which the first transport path is opened, wherein when the door is in the opened state, the switching section is displaced to a third state in which at least a portion of the second transport path is opened.

According to this aspect, the medium transport apparatus includes a door that is displaceable between a closed state in which the door forms at least a portion of the first transport path and an opened state in which the door is opened at least a portion of the first transport path. Therefore, the first transport path can be opened by opening the door, and a medium that has failed to be transported in the first transport path can be easily removed. Further, while the door is in the opened state, the switching section is displaced to a third state in which the second transport path is opened. Therefore, the second transport path can be opened by opening the door, and the medium that has failed to be transported in the second transport path can be easily removed.

A medium transport apparatus according to a second aspect is the medium transport apparatus according to the first aspect, wherein the switching section includes an interlocking section configured to move in conjunction with displacement of the door, and a switching section pivot shaft extending along a width direction that intersects a transport direction of the medium in the transport path, the door is configured to move the interlocking section with displacement between the closed state and the opened state, and the switching section pivots about the switching section pivot shaft by movement of the interlocking section accompanying displacement of the door.

According to this aspect, the switching section includes an interlocking section and a switching section pivot shaft, the door is configured to move the interlocking section with displacement between the closed state and the opened state, and the switching section pivots about the switching section pivot shaft by movement of the interlocking section accompanying displacement of the door. With such a configuration, the switching section pivots by a movement of the interlocking section with opened/closed of the door, and the apparatus configuration can be simplified.

A medium transport apparatus according to a third aspect is the medium transport apparatus according to the second aspect, an engagement section that is displaceable in a state of being engaged with the interlocking section and a biasing section configured to, while the door is in the closed state, bias the engagement section such that the switching section is biased in a direction in which the switching section is displaced to the third state.

According to this aspect, the medium transport apparatus includes the engagement section that is displaceable in a state of being engaged with the interlocking section, and the biasing section that biases the engagement section so as to be biased in a direction in which the switching section is displaced to the third state when the door is in the closed state. Therefore, the switching section can be displaced into the third state in accordance with displacement of the door from the closed state to the opened state, with a simple configuration of only the biasing section.

A medium transport apparatus according to a fourth aspect is the medium transport apparatus according to the third aspect, wherein the engagement section is linearly movable in a state of being engaged with the interlocking section.

According to this aspect, the engagement section is linearly movable in a state of being engaged with the interlocking section. By configuring the engagement section to be linearly movable, a movement region can be narrowed, thereby it can prevent the size of the apparatus from becoming larger in size.

A medium transport apparatus according to a fifth aspect is the medium transport apparatus according to any one of the second to fourth aspects, wherein assuming that a direction in which the switching section is displaced from the first state to the second state is a first direction, when the door is in the closed state, a force due to its own weight is applied to the switching section so that the switching section pivots toward the first direction side about the switching section pivot shaft.

In a configuration in which a force due to its own weight is applied to the switching section so as to pivot toward the first direction side about the switching section pivot shaft when the door is positioned in the closed state, the second transport path is less likely to be opened when the door is positioned in the opened state. However, as described above, according to this aspect, when the door is in the opened state, the switching section is displaceable to the third state in which the second transport path is opened in conjunction with the displacement of the door. Therefore, the second transport path can be opened by opening the door, and the medium that has failed to be transported in the second transport path can be easily removed.

A medium transport apparatus according to a sixth aspect is the medium transport apparatus according to any one of the second to fifth aspects, wherein the door has a door pivot shaft along a direction intersecting the width direction.

According to this aspect, the door has the door pivot shaft along the direction intersecting the width direction. That is, the directions of the door pivot shaft and the switching section pivot shaft are different from each other. When the directions of the door pivot shaft and the switching section pivot shaft are different from each other, it is generally difficult to integrally displace the door and the switching section. However, according to this aspect, as described above, the interlocking section is movable with the displacement of the door and pivots about the switching section pivot shaft by the movement of the interlocking section, and thus the door and the switching section can be integrally displaced.

A medium transport apparatus according to a seventh aspect is the medium transport apparatus according to any one of the first to sixth aspects, wherein, when the door is in the closed state, the door configures at least a portion of the first transport path and configures at least a portion of the transport path other than the first transport path.

According to this aspect, while the door is in the closed state, the door configures at least a portion of the first transport path and configures at least a portion of the transport path other than the first transport path. Therefore, it is possible to reduce the number of constructional elements of the transport path, and to reduce the cost and size of the apparatus.

A medium transport apparatus according to an eighth aspect is the medium transport apparatus according to any one of the first to seventh aspects, wherein the first transport path and the second transport path are disposed at positions at which at least a portion of the first transport path and a portion of the second transport path overlap each other in the gravity direction.

According to this aspect, the first transport path and the second transport path are arranged so that they overlap each other at least partially in a gravity direction. Therefore, the size of the apparatus can be reduced. In addition, when the first transport path and the second transport path are arranged at a position at which at least a portion thereof overlaps in the gravity direction, in general, the region in which the switching section covers the second transport path increases, and it is difficult to easily remove the medium that has failed to be transported in the second transport path. However, as described above, according to this aspect, the switching section is displaceable to the third state in which the second transport path is opened when the door is in the opened state. Therefore, the second transport path can be opened by opening the door, and the medium that has failed to be transported in the second transport path can be easily removed.

A recording apparatus according to a ninth aspect includes the medium transport apparatus according to any one of the first to eighth aspects and a recording section that performs recording on the medium.

According to this aspect, the recording section that performs recording on the medium is provided. Therefore, it is possible to easily remove the medium that has failed to be transported on the transport path due to recording on the medium.

A recording apparatus according to a tenth aspect is the recording apparatus according to the ninth aspect, further includes a medium accommodation section for containing the medium, wherein the first transport path is an inversion path that inverts a recorded medium on which recording was performed by the recording section and transports the inverted recorded medium to the third transport path, the second transport path is a feeding transport path for feeding the medium accommodated in the medium accommodation section to the third transport path, and the third transport path is a recording transport path including a recording position of the recording section.

According to this aspect, the recording apparatus further includes a medium accommodation section that accommodates the medium, wherein the first transport path is the inversion path which inverts a recorded medium on which recording has been performed by the recording section and transports to the third transport path, the second transport path is a feeding transport path that feeds the medium accommodated in the medium accommodation section to the third transport path, and the third transport path is a recording transport path during recording that includes a recording position in the recording section. For this reason, the inversion path and the feeding transport path are opened by opening the door, and it is possible to easily remove the medium that has failed to be transported in the inversion path and the feeding transport path.

A recording apparatus according to an eleventh aspect is the recording apparatus according to the tenth aspect, wherein the first transport path and the medium accommodation section are disposed at positions that at least partially overlap in the gravity direction.

According to this aspect, the first transport path and the medium accommodation section are arranged at a position at which at least a portion thereof overlaps in the gravity direction. Therefore, the size of the apparatus can be reduced.

Hereinafter, the present disclosure will be specifically described. First, an inkjet printer 1, which is a recording apparatus and also a medium transport apparatus of the present disclosure, will be described. Hereinafter, the inkjet printer 1 will be referred to as printer 1. The X-Y-Z coordinate system shown in each drawing is an orthogonal coordinate system, and a Y axis direction is a direction intersecting with a transport direction of a medium P, that is, a medium width direction, and is also an apparatus depth direction. In the Y axis direction, a +Y direction is a direction from an apparatus front surface toward an apparatus back surface, and a −Y direction is a direction from the apparatus back surface toward the apparatus front surface.

The X axis direction is the apparatus width direction and, as viewed from an operator of the printer 1, the +X direction is the left side and the −X direction is the right side. The Z axis direction is a vertical direction, that is, an apparatus height direction, and a +Z direction is an upward direction and a −Z direction is a downward direction. Hereinafter, a direction in which the medium P is fed may be referred to as "downstream", and a direction opposite thereto may be referred to as "upstream". In the figures, a medium transport path is indicated by broken line. In the printer 1, the medium P is transported through a medium transport path indicated by a broken line.

An F axis direction is a medium transport direction between a transport belt 13 and a line head 51 (to be described later), that is, in a recording region, and a +F direction is downstream in the transport direction and the opposite −F direction is upstream in the transport direction. In addition, a V axis direction is a movement direction of a head unit 50 (to be described later), a +V direction in the V axis direction is a direction in which the head unit 50 moves away from the transport belt 13, and a −V direction is a direction in which the head unit 50 approaches the transport belt 13. In the present embodiment, the +V direction is defined as a medium discharge direction. In the present embodiment, the V axis direction is also a direction along an inclination of a discharge tray 8 (to be described later).

The printer 1 includes a housing 16 of an apparatus main body 2 and a door 17 that is pivotable with respect to the housing 16 with the Z axis direction as a pivot axis. In addition, the printer 1 includes a first medium cassette 3 that contains a medium P in a lower portion of the apparatus main body 2, and further is configured such that an extension unit 6 can be coupled to a lower side of the apparatus main body 2. When the extension unit 6 is connected, a second medium cassette 4 and a third medium cassette 5 are positioned below the first medium cassette 3. The medium P fed out from each medium cassettes is transported inside the printer 1 in a medium transport path indicated by broken line.

Each medium cassette is provided with a pick up roller that sends out the stored medium P in the −X direction. The pick up rollers 21, 22, 23 are pick up rollers provided for the first medium cassette 3, the second medium cassette 4, and the third medium cassette 5, respectively. Each medium cassette is provided with a feed roller pair that feeds the medium P sent out in the −X direction obliquely upward. The feed roller pairs 25, 26, 27 are provided for the first medium cassette 3, the second medium cassette 4, and the third medium cassette 5, respectively. In the following description, unless otherwise specified, a "roller pair" includes a driving roller that is driven by a motor (not shown) and a driven roller that is driven to rotate by contact with the driving roller.

Figure 4:
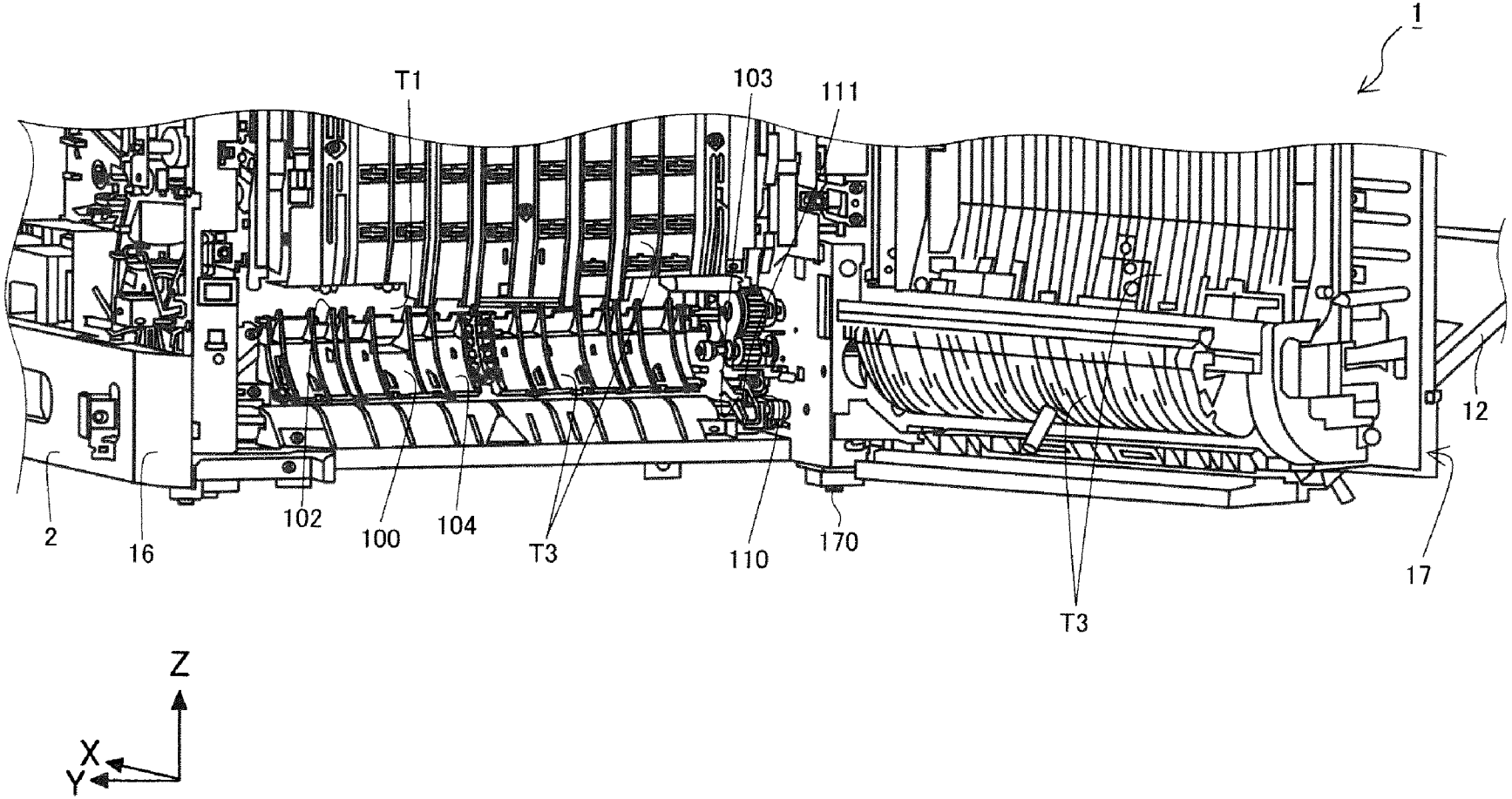
FIG. 4 shows a state in which a door of the printer in FIG. 1 is opened, and shows the switching section positioned in the second state.

The medium P fed out from the third medium cassette 5 is sent to an inversion roller 39 by transport roller pairs 29, 28. The medium P fed out from the second medium cassette 4 is sent to the inversion roller 39 by the transport roller pair 28. The medium P is nipped by the inversion roller 39 and a driven roller 40, and is sent to a transport roller pair 31. The medium P sent out from the first medium cassette 3 is sent to the transport roller pair 31 without passing by the inversion roller 39. A feed roller 19 and a separation roller 20 provided near the inversion roller 39 are a roller pair that feeds the medium P from a feed tray 12, which is shown in FIG. 4 and omitted from FIG. 1.

A transport path of the medium P from the feed roller pair 25 to the transport roller pair 31 curves so as to protrude downward. The transport path of the medium P from the nip position between the inversion roller 39 and the driven roller 40 to the transport roller pair 31 also curves so as to protrude downward. Hereinafter, the transport path of the medium P from the feed roller pair 25 to the transport roller pair 31 and the transport path of the medium P from the nip position between the inversion roller 39 and the driven roller 40 to the transport roller pair 31 will be referred to as a curved transport path R1.

A detector 70 that detects the medium P and a switching section 100 that switches the transport path of the medium P are provided in the curved transport path R1. The detector 70 detects the presence or absence of the medium P transported on the curved transport path R1, and detects the width of the medium P by detecting the end portions of the medium P in the medium width direction. Details of the switching section 100 that is a main part of the printer 1 of the present embodiment will be described later.

The medium P that receives a feeding force from the transport roller pair 31 is fed to a position between the transport belt 13 and the line head 51, which is an example of a recording section, that is, to a recording position facing the line head 51. Hereinafter, a medium transport path from the transport roller pair 31 to a transport roller pair 32 will be referred to as a recording transport path T1.

The line head 51 constitutes the head unit 50. The line head 51 executes recording by ejecting ink, which is an example of liquid, onto the surface of the medium P. The line head 51 is an ink ejecting head configured such that nozzles that eject ink cover the entire region in the medium width direction, and is configured as an ink ejecting head capable of recording on the entire region in the medium width direction without moving in the medium width direction. However, the ink ejection head is not limited thereto, and may be a type that is mounted on a carriage and ejects ink while moving in the medium width direction. Further, as the recording unit, it is also possible to use a recording unit having a configuration other than an ink ejection head, such as a thermal transfer type recording unit.

The head unit 50 is provided so as to be movable toward and away from the recording transport path T1, and is provided so as to be displaceable between a recording position indicated by solid line in FIG. 1 and a retracted position most retracted from the transport belt 13 as indicated in FIG. 1 by two dot chain line and by the reference numeral 50-1. When the head unit 50 is at the retreat position, maintenance of the line head 51 is performed by a maintenance section (not shown). In this embodiment, the displacement direction of the head unit 50 is the V axis direction along the inclination of the discharge tray 8. The head unit 50 is located on the upstream side in the medium discharge direction below the discharge tray 8 and is displaced along a lower surface 8*e* of the discharge tray 8.

The printer 1 includes an ink containers 61, 62, 63, 64 as a liquid containing section. Ink ejected from the line head 51 is supplied from the ink containers to the line head 51 via tubes (not shown). Each ink container is detachably provided. The printer 1 also includes a waste liquid container 11 that stores, as waste liquid, ink discharged for maintenance from the line head 51 toward a flushing cap (not shown).

The transport belt 13 is an endless belt wound around a pulley 14 and a pulley 15, and rotates by at least one of the pulley 14 and the pulley 15 being driven by a motor (not shown). The medium P is transported to a position facing the line head 51 while being attracted to the belt surface of the transport belt 13. The attraction of the medium P to the transport belt 13 may employ a known attraction method such as an air suction method or an electrostatic attraction method.

The recording transport path T1 that passes through the position facing the line head 51 forms an angle with respect to the horizontal direction and the vertical direction, and transports the medium P upward. This upward transport direction is a direction including a −X direction component and a +Z direction component in FIG. 1, and with such a configuration, it is possible to suppress the horizontal direction dimension of the printer 1. In this embodiment, the recording transport path T1 is set at an inclination angle in the range of 65° to 85° with respect to the horizontal direction, and more specifically, at an inclination angle of approximately 75°. However, the angle is not limited to these angles.

The medium P on which recording has been performed on the first surface by the line head 51 is further transported upward by the transport roller pair 32, which is positioned downstream from the transport belt 13. A flap 41 is provided downstream of the transport roller pair 32, and the transport direction of the medium P is switched by the flap 41. When the medium P is to be discharged as is, the transport path of the medium P is switched upward by the flap 41 toward a transport roller pair 35, and the medium P is discharged toward the discharge tray 8 by the transport roller pair 35.

When, in addition to the first surface of the medium P, recording is to be performed on a second surface, which is opposite to the first surface, the transport direction of the medium P is directed by the flap 41 toward a branch position K1. Then, the medium P passes through the branch position K1 and enters a switchback path T2. In the present embodiment, the switchback path T2 is the medium transport path above the branching position K1. The switchback path T2 is provided with two pairs of transport roller pairs 36, 37. The medium P entering the switchback path T2 is transported upward by the transport roller pairs 36, 37, and when the trailing edge of the medium P has passed through the branch position K1, the direction of rotation of the transport roller pairs 36, 37 is switched, and the medium P is thereby transported downward. Note that the "upward direction" does not mean only the vertically upward direction, but means that at least a vector component in the vertically upward direction is included, and the "downward direction" does not mean only the vertically downward direction, but means that at least a vector component in the vertically downward direction is included.

The inversion path T3 is coupled to the switchback path T2. In the present embodiment, the inversion path T3 is a medium transport path from the branch position K1, past the transport roller pairs 33, 34 and the inversion roller 39, to the merging point P1. The medium P transported downward from the branch position K1 receives feeding force from the transport roller pairs 33, 34, reaches the inversion roller 39, is inverted by curling around the inversion roller 39, and is transported toward the transport roller pair 31.

The medium P transported by the transport roller pair 31 and the like and again sent to the position facing the line head 51 has the second surface, which is the opposite side than the first surface on which recording has already been performed, facing the line head 51. This enables recording by the line head 51 on the second surface of the medium P. Here, the medium transport path from the first medium cassette 3 to the switching section 100 is referred to as a feeding transport path T0. Therefore, it can be said that the switching section 100 is provided at the merging point P1 between the feeding transport path T0 and the inversion path T3, and the medium transport path downstream from the merging point P1, which is between the feeding transport path T0 and the inversion path T3, to the transport roller pair 32 constitutes the recording transport path T1.

Figure 2:
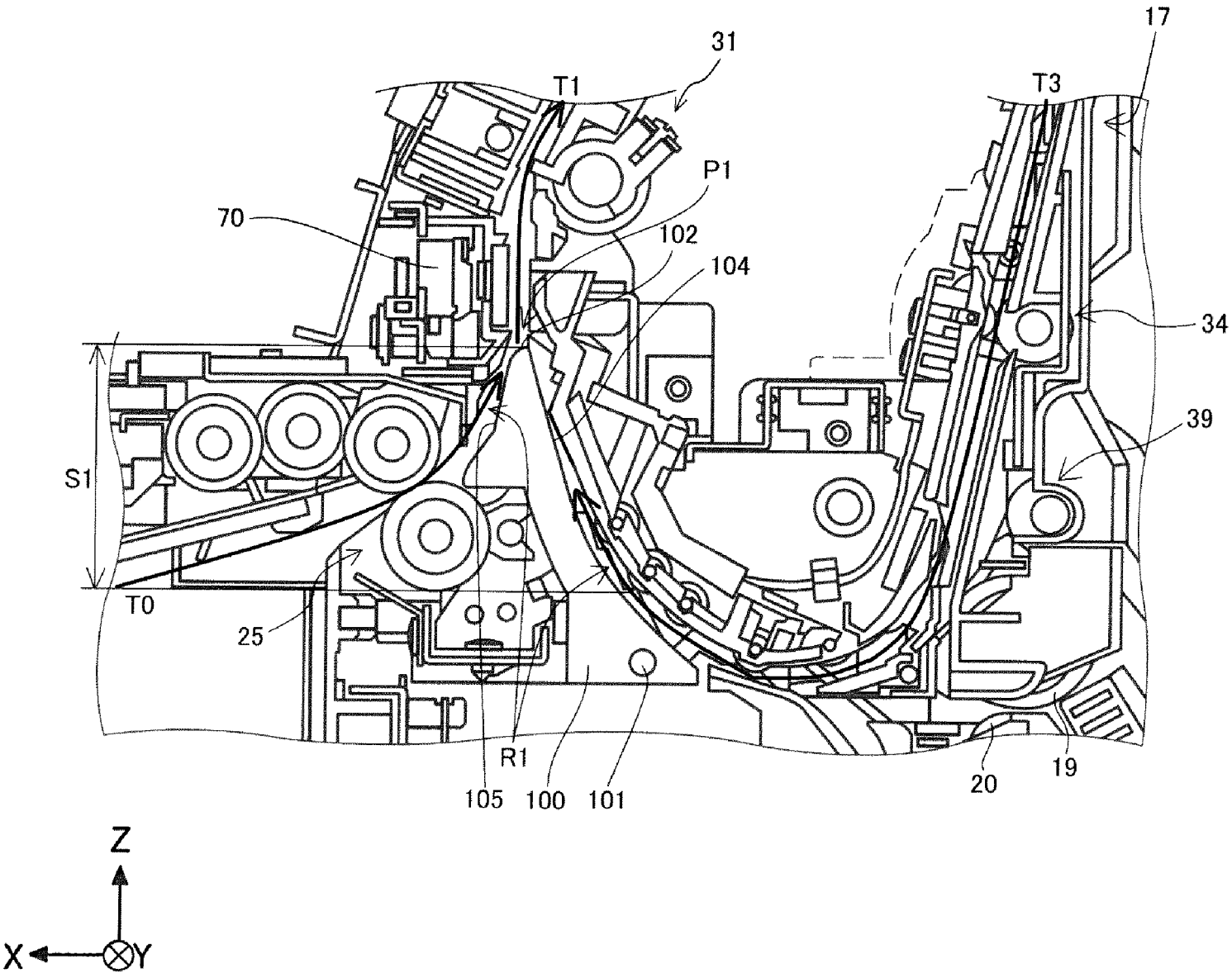
FIG. 2 shows the periphery of a switching section of the printer in FIG. 1, and shows the switching section positioned in a first state.

Next, with reference to FIGS. 2 to 8, the switching section 100, which is a main part of the printer 1 of the present embodiment, will be described in detail. The role of the switching section 100 is to switch between the feeding transport path T0 and the inversion path T3. To be specific, when the medium P is to be fed from the first medium cassette 3, then as shown in FIG. 2, the feeding transport path T0 is opened and the inversion path T3 is closed. On the other hand, in situations such as when the recording has been performed on the first surface of the medium P and recording is to be subsequently performed on the second surface of the medium P and when the extension unit 6 is coupled to the apparatus main body 2 and the medium P is fed from the second medium cassette 4 or the third medium cassette 5, then as shown in FIG. 3, the inversion path T3 is opened and the feeding transport path T0 is closed.

Figure 3:
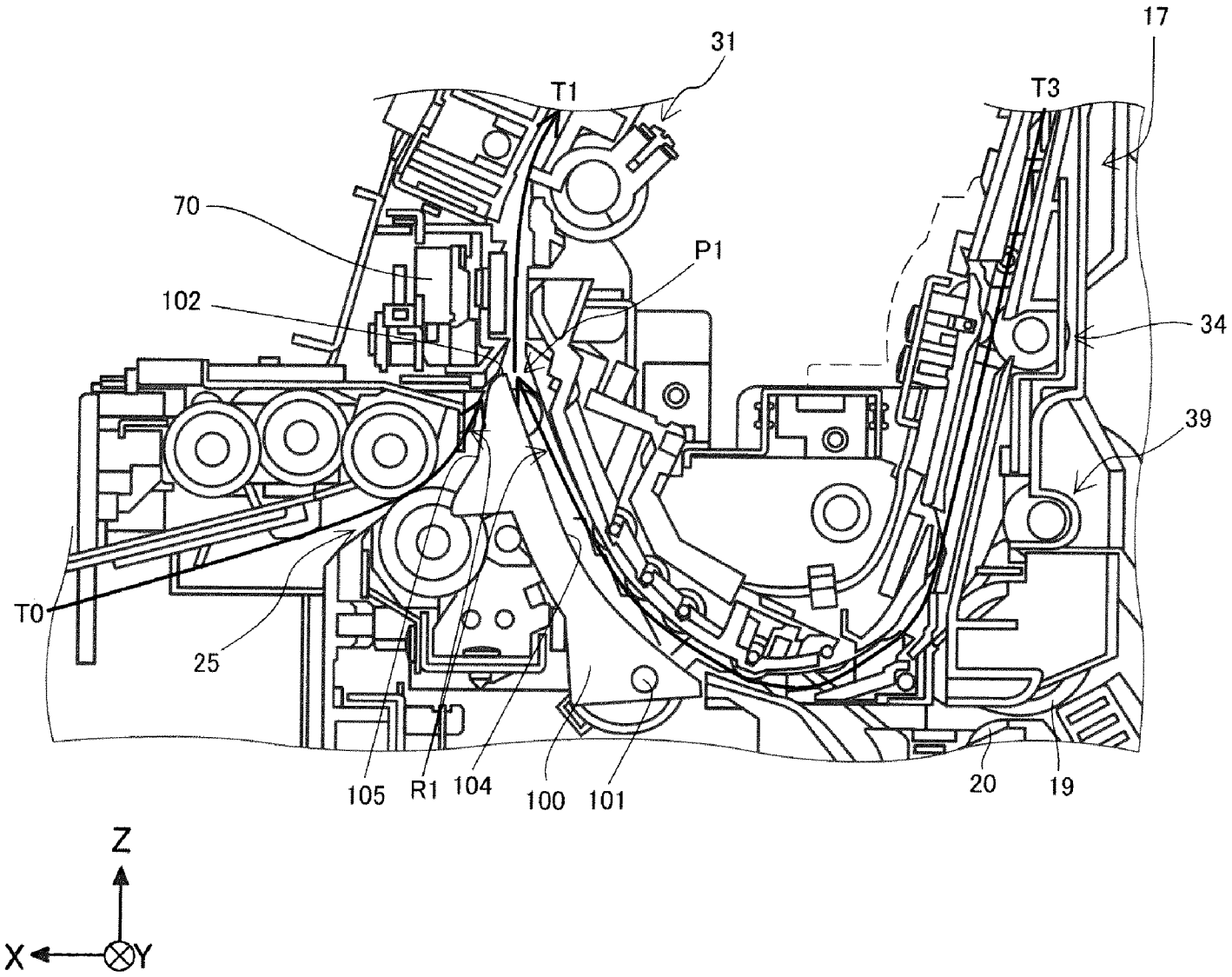
FIG. 3 shows the periphery of the switching section of the printer in FIG. 1, and shows the switching section positioned in a second state.
Figure 8:
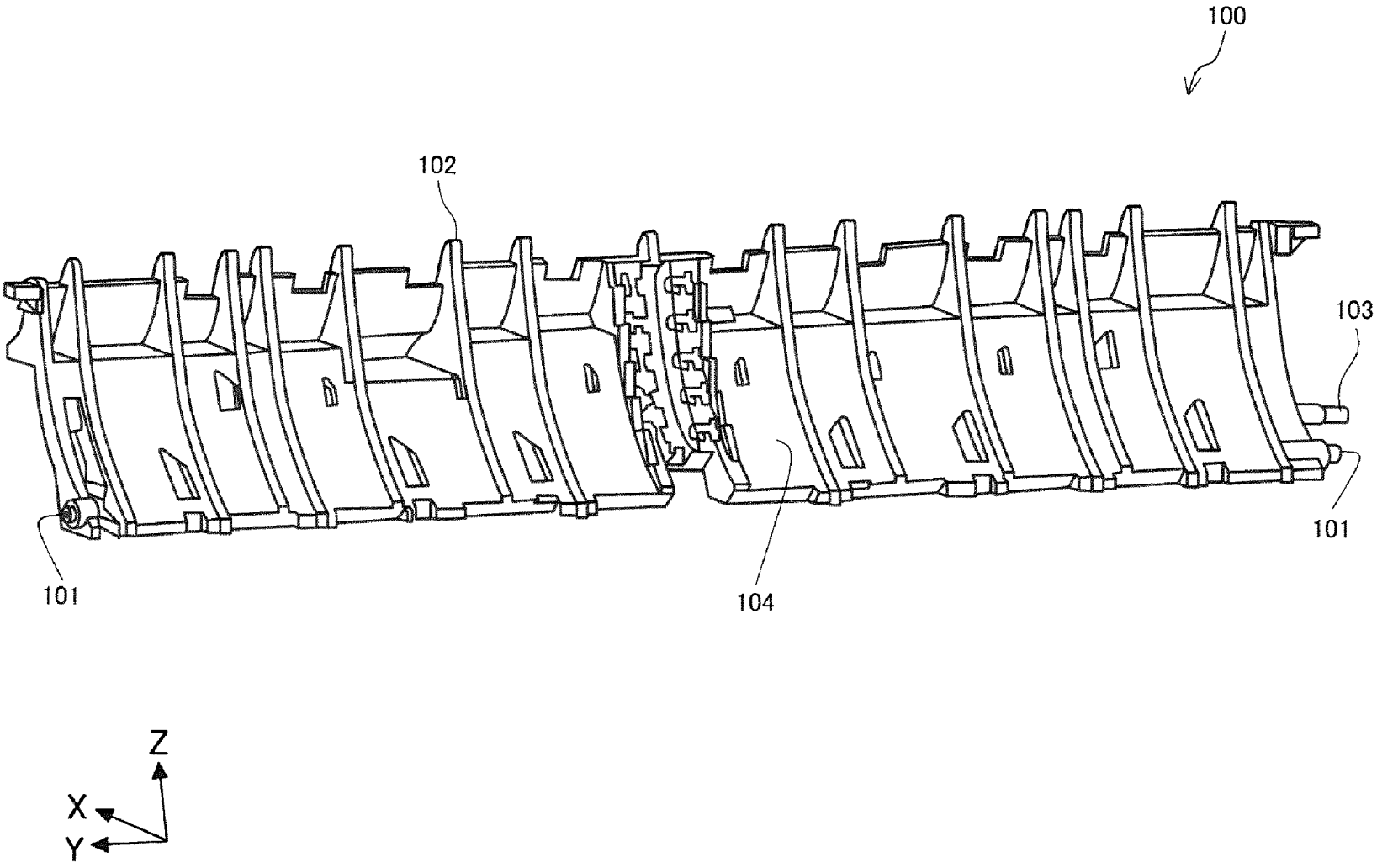
FIG. 8 shows the switching section of the printer in FIG. 1.

As shown in FIGS. 2, 3, and 8, assuming that the Y axis direction is a longitudinal direction and the Z axis direction is a transverse direction, the switching section 100 is formed on the −Z direction side, which is one end side in the transverse direction, with a switching section pivot shaft 101, as a pivot shaft extending in the Y axis direction. The switching section 100 can pivot about the switching section pivot shaft 101. In FIGS. 2 and 3, a tip end 102 on the +Z direction side, which is the other transverse direction end side of the switching section 100, is located on the +X direction side of the switching section pivot shaft 101. Further, there is a large amount of play (backlash) between a recess 111 and a protrusion 103. Therefore, the switching section 100 adopts the second state shown in FIG. 3 as its basic posture due to its own weight. However, when the medium P is fed from the first medium cassette 3, the feeding direction leading end of the medium P being fed presses a surface 105 of the switching section 100 to the −X direction side while contacting the switching section 100, and thus the switching section 100 is put into the first state shown in FIG. 2.

As shown in FIGS. 2 and 3, the switching section 100 is provided at the merging point P1 between the feeding transport path T0 and the inversion path T3. For this reason, the pivot range of the switching section 100 is from a position where the tip end 102 contacts the +X direction side portion of the feeding transport path T0 to the position where the tip end 102 contacts the −X direction side portion of the inversion path T3. Note that the switching section 100 need not contact the path surface when closing one of the feeding transport path T0 and the inversion path T3, as long as the passage of the medium P is regulated. Here, assuming that a gap between a surface in the transport path facing the first surface of the medium P and a surface in the transport path facing the second surface of the medium P is referred to as a transport path height, the transport path height at the merging point P1 is substantially the transport path height of one of the feeding transport path T0 or the inversion path T3. That is, it can be said that the pivot range of the switching section 100 is a range substantially corresponding to the transport path height of one transport path. However, since FIGS. 2 and 3 show a closed state in which the door 17 is closed with respect to the housing 16, it is in the closed state that the pivotal range of the switching section 100 becomes a range corresponding to the transport path height of approximately one transport path.

Figure 5:
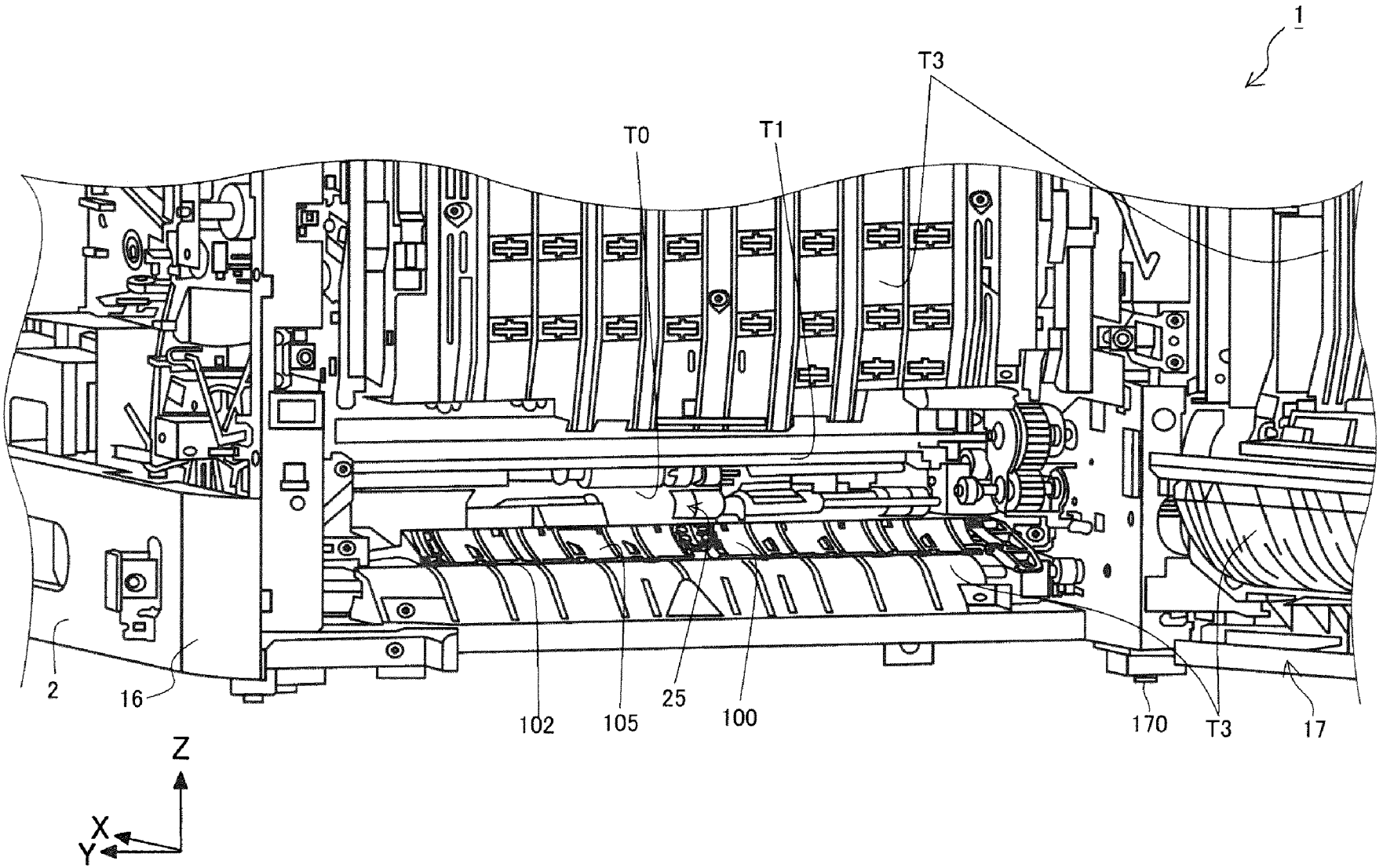
FIG. 5 shows a state in which a door of the printer in FIG. 1 is opened, and shows the switching section positioned in a third state.

Here, FIGS. 2 and 3 show a closed state in which the door 17 is closed with respect to the housing 16. As shown in FIGS. 4 and 5, the printer 1 of the present embodiment can be placed in an opened state in which the door 17 is opened with respect to the housing 16. Note that when the printer 1 of the present embodiment is in an open state in which the door 17 is opened with respect to the housing 16, the switching section 100 is in a third state as shown in FIG. 5. FIG. 4 shows the appearance of the switching section 100 in the second state with the door 17 in the open state, but such a state does not actually occur in the printer 1 of the present embodiment.

As shown in FIG. 5, when the printer 1 of the embodiment is placed in the opened state in which the door 17 is opened with respect to the housing 16, the switching section 100 switches from the second state to the third state. To be specific, as can be seen from a comparison between FIGS. 4 and 5, the switching section 100 pivots so as to open the feeding transport path T0. Hereinafter, a mechanism in which the switching section 100 changes from the second state to the third state when the door 17 changes from the closed state to the opened state will be described with reference to FIGS. 6 to 8.

As shown in FIG. 8, the switching section 100 is formed with a switching section pivot shaft 101 at both ends in the Y axis direction, which is the longitudinal direction, and to the −Z direction side in the Z axis direction, which is the transverse direction. In addition, the protrusion 103, which protrudes in the −Y direction, is formed on the switching section 100 near the switching section pivot shaft 101 on the −Y direction side in the Y axis direction, which is the longitudinal direction. As shown in FIGS. 2 and 3, a surface 104 on the −X direction side of the switching section 100 configures a portion of the inversion path T3, and the surface 105 on the +Z direction side and the +X direction side of the switching section 100 configures a portion of the feeding transport path T0. The protrusion 103 is an example of an interlocking section.

Figure 6:
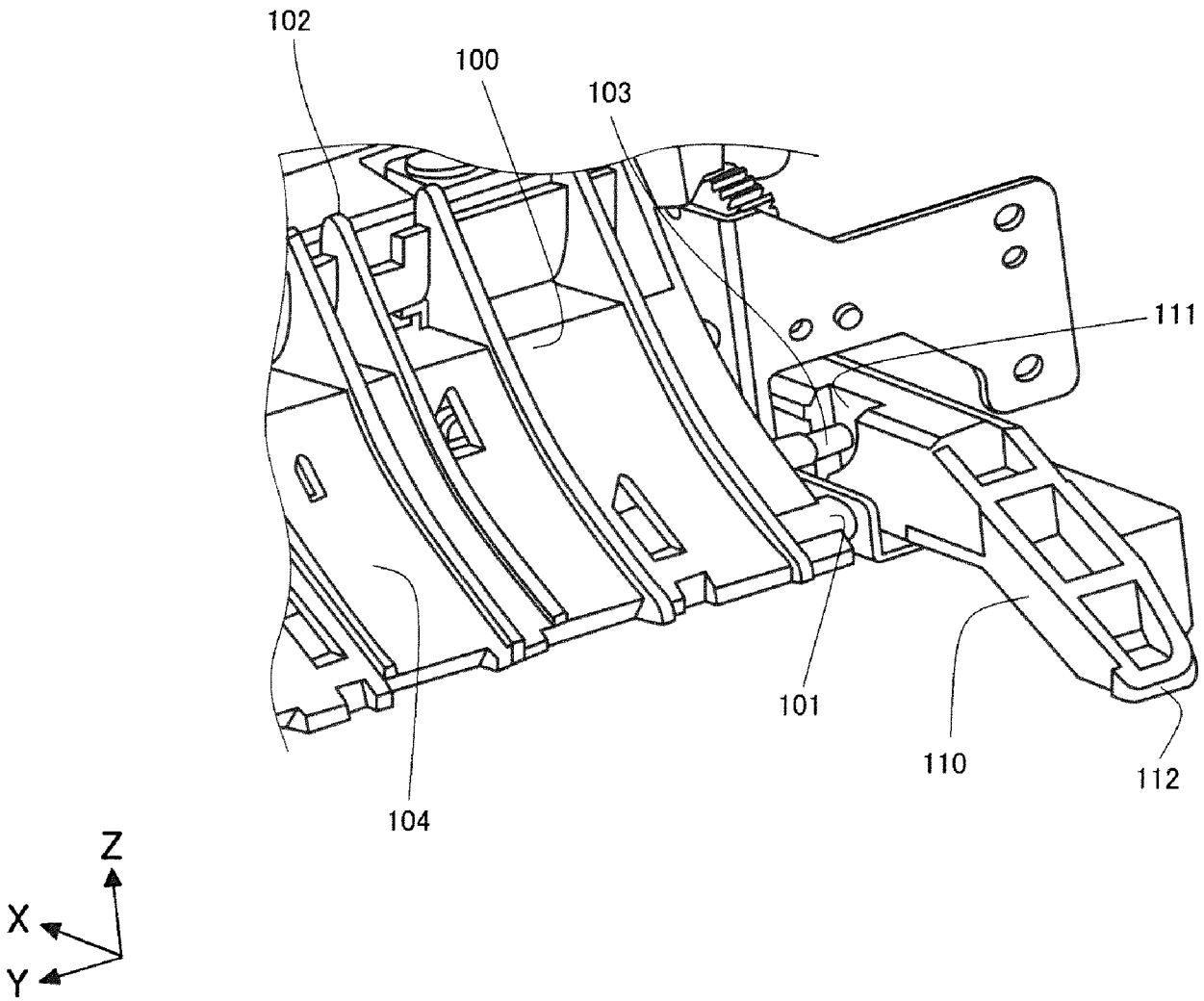
FIG. 6 shows an arrangement of the switching section and a slider in the state in FIG. 4.
Figure 7:
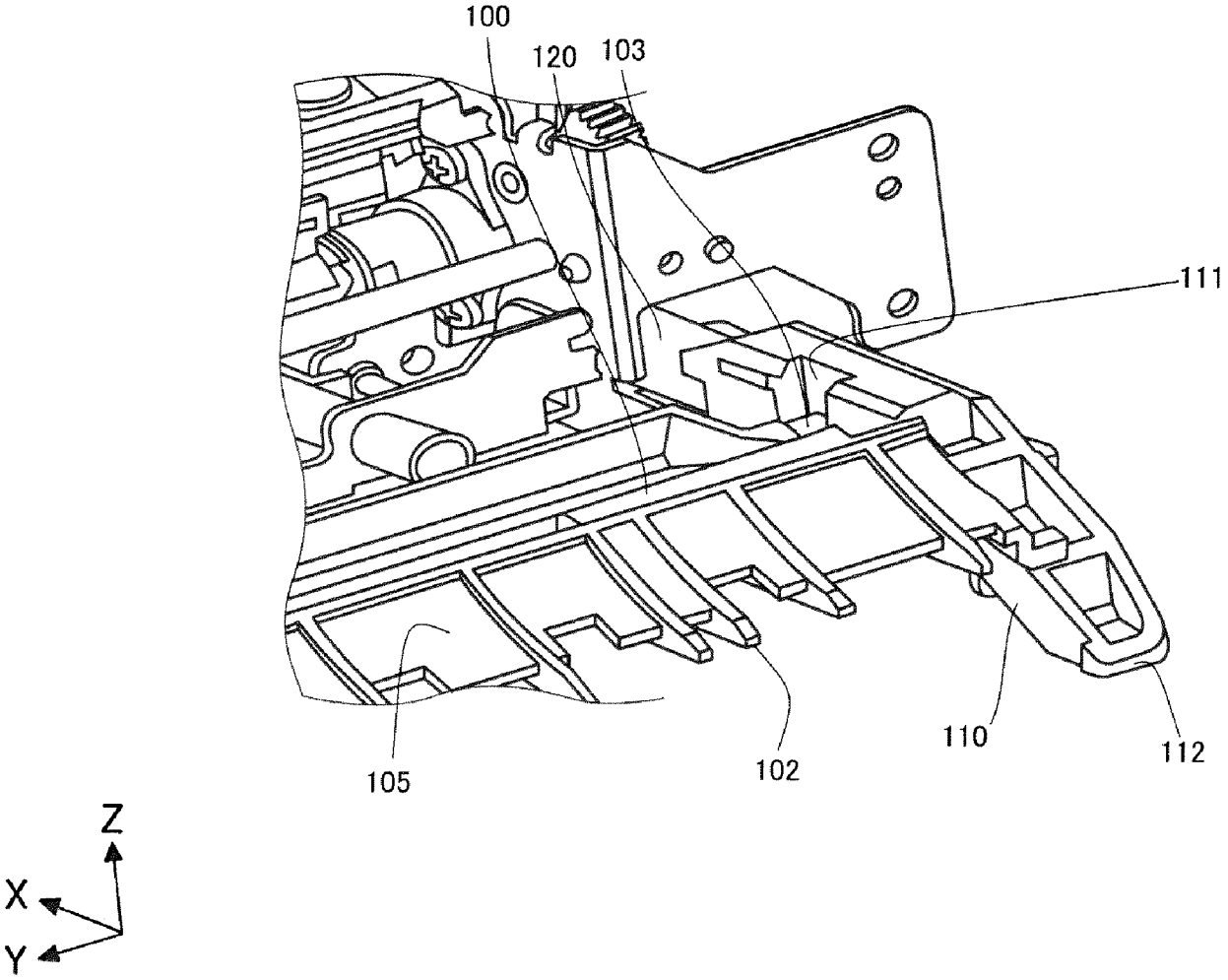
FIG. 7 shows an arrangement of the switching section and a slider in the state of FIG. 5.

As shown in FIG. 7, the printer 1 includes a spring 120 and a slider 110 that is biased in the −X direction by the spring 120. The slider 110 is arranged at the position shown in FIG. 6 by an −X direction side end 112 abutting the door 17 in the closed state in which the door 17 is closed, but protrudes to the −X direction side as shown in FIG. 7 in the opened state in which the door 17 is opened. As shown in FIGS. 6 and 7, the slider 110 is formed with the recess 111 into which the protrusion 103 of the switching section 100 is fitted, and the switching section 100 is displaced from the state shown in FIG. 6 to the state shown in FIG. 7 as the slider 110 pops out toward the −X direction side. Since the protrusion 103 is provided on the free end side of the switching section 100 with respect to the switching section pivot shaft 101, the displacement of the slider 110 and the displacement of the switching section 100 can be interlocked with each other. Here, it is desirable that the protrusion 103 is provided at a position closer to the switching section pivot shaft 101 than half of the length of the switching section 100. This is because the closer that the protrusion 103 is to the switching section pivot shaft 101, the shorter that the displacement distance of the slider 110 can be. Here, the state shown in FIG. 6 corresponds to the states shown in FIGS. 3 and 4, that is, corresponds to the second state. On the other hand, the state shown in FIG. 7 corresponds to the state shown in FIG. 5, that is, corresponds to the third state. As the door 17 pivots from the opened state to the closed state, the end 112 of the slider 110 is pushed by the door 17 toward the +X direction side, and the switching section 100 pivots about the switching section pivot shaft 101 and is displaced from the third state shown in FIG. 7 to the second state shown in FIG. 6.

Here, in summary, the printer 1 according to the present embodiment includes a transport path of a medium that has the inversion path T3, as an example of a first transport path, the feeding transport path T0, as an example of a second transport path, and the recording transport path T1, as an example of a third transport path, that is formed the inversion path T3 and the feeding transport path T0 merging at the merging point P1. In addition, the door 17 is provided which is displaceable between a closed state, in which the door 17 forms a portion of the inversion path T3 as shown in FIGS. 1 to 3, and an opened state, in which the door 17 opens up a portion of the inversion path T3 as shown in FIGS. 4 and 5. In addition, the switching section 100 of the transport path is provided that, when the door 17 is located in the closed state, is displaceable between the first state in which the inversion path T3 is closed and the feeding transport path T0 is opened as shown in FIG. 2 and a second state in which the feeding transport path T0 is closed and the inversion path T3 is opened as shown in FIG. 3, and that is provided at the merging point P1. As shown in FIG. 5, when the door 17 is positioned in the opened state, the switching section 100 can be displaced to a third state in which at least a portion of the feeding transport path T0 is opened.

As in the printer 1 of the present embodiment, by providing the door 17 that can be displaced between the closed state in which it configures at least a portion of the first transport path and the opened state in which at least a portion of the first transport path is opened, the first transport path can be opened by opening the door 17, and medium P that has failed to be transported in the first transport path can be removed. Here, in the present embodiment, the door 17 constitutes a portion of the inversion path T3 in the closed state, but may constitute the entire inversion path T3 in the closed state. In addition, although the merging point of the first and second transport path where the switching section 100 is arranged, is the merging point P1 of the inversion path T3 and the feeding transport path T0, it is not limited to this. The first transport path does not need to be the inversion path T3, the second transport path does not need to be the feeding transport path T0, and the merging point of the first and second transport path does not need to be the merging point of the inversion path T3 and the feeding transport path T0. For example, a feeding transport path from the medium cassette 4 or 5, which is a medium feeding transport path from the medium cassette 4 or 5 to the merging point P1 via the inversion roller 39 and the driven roller 40, can be regarded as the first transport path. In addition, it may be a branch point instead of a merging point. Note that since the medium transport path that merges at the merging point P1 is the first transport path, a manual feed path or the feeding transport path from the medium cassette 4 or 5 can also be regarded as the first transport path.

In a general printer, it is sometimes difficult to remove the medium P that has failed to be transported in the feeding transport path T0. However, as described above, in the printer 1 of the present embodiment, the switching section 100 is displaceable to the third state in which the feeding transport path T0 is opened up when the door 17 is in the opened state. For this reason, in the printer 1 of the embodiment, it is possible to open up the feeding transport path T0 by opening the door 17, and to easily remove the medium P that has failed to be transported in the feeding transport path T0.

Further, the switching section 100 is configured so that while the door 17 is positioned in the closed state, the switching section 100 can be displaced between a first state in which the inversion path T3 is closed and the feeding transport path T0 is opened and a second state in which the feeding transport path T0 is closed and the inversion path T3 is opened. That is, it is possible to narrow the displaceable range of the switching section 100 when the door 17 is positioned in the closed state, and it is possible to reduce the size of the apparatus. This is because, as described above, with the configuration according to the present embodiment, the displaceable range of the switching section 100 can be set to a range corresponding to one inversion path T3 or one feeding transport path T0. That is, the height of the transport path after merging can be set to a range corresponding to that of the inversion path T3 or the feeding transport path T0. In a general apparatus in the related art, a member such as a flap formed at a merging point P1 of the inversion path T3 and the feeding transport path T0 is generally configured to simply guide with the transport direction of the medium P in the inversion path T3 and the feeding transport path T0 in a fixed state, and is not configured to be displaced according to the transport state of the medium P, and therefore the height of the transport path after merging is often in a range of two heights, which is the sum of the heights of the inversion path T3 and the feeding transport path T0.

Further, in the present embodiment, the direction of a door pivot shaft 170 shown in FIGS. 4 and 5 is a vertical direction corresponding to the Z axis, and the direction of the switching section pivot shaft 101 is a horizontal direction corresponding to the X axis. However, the present disclosure is not limited to such a configuration. The direction of the door pivot shaft 170 and the direction of the switching section pivot shaft 101 are not particularly limited, and may be the same direction.

Further, in the present embodiment, the timing at which the door 17 starts moving from the closed state to the open state is the same as the timing at which the switching section 100 starts displacement to the third state. However, the present disclosure is not limited to such a configuration. For example, like a configuration in which the door 17 moves from the closed state to the opened state and then the switching section 100 is displaced to the third state, the timing at which movement of the door 17 starts and the timing at which movement ends between the closed state and the opened state may be shifted from the timing that displacement of the switching section 100 starts and the timing that displacement ends at the third state. A configuration may be adopted in which the displacement of the door 17 between the closed state and the opened state is performed by the weight of the switching section 100.

The printer 1 of the present embodiment is a medium transport apparatus that has the features described above, and is also a recording apparatus that includes the medium transport apparatus that has the features described above and the line head 51 as a recording apparatus that performs recording on the medium P. Therefore, in the printer 1 according to the present embodiment, it is possible to easily remove the medium P that has failed to be transported in the transport path caused by recording on the medium P.

As shown in FIG. 8 and the like, the switching section 100 includes the protrusion 103, and the switching section pivot shaft 101 along the Y axis direction, which corresponds to the width direction, which intersects the transport direction of the medium P in the transport path. Further, as shown in FIGS. 6 and 7 and the like, the door 17 is capable of moving the protrusion 103 along the X axis direction as the door 17 is displaced between the closed state and the opened state, and the switching section 100 pivots about the switching section pivot shaft 101 by the protrusion 103 moving with displacement of the door 17. Since the printer 1 of the present embodiment has such a configuration, the switching section 100 can be pivoted by moving the protrusion 103 with opening and closing of the door 17, and the apparatus configuration can be simplified.

The printer 1 of the present embodiment has a configuration in which the slider 110, which is engaged with the protrusion 103, is linearly moved along the X axis direction with opening and closing of the door 17, but is not limited to such a configuration. For example, a configuration may be adopted in which the door 17 directly moves the protrusion 103 with opening and closing of the door 17, without intervention of another member. Further, instead of the slider 110 that moves linearly, a member may be provided that pivots the protrusion 103 with opening and closing of the door 17.

In other words, the printer 1 of the present embodiment is provided with the slider 110 as an engagement section that is displaceable while engaged with the protrusion 103. In addition, the printer 1 of the present embodiment includes the spring 120 as a biasing section that, while the door 17 is positioned in the closed state, biases the slider 110 such that the switching section 100 is biased in the direction in which the switching section 100 is displaced into the third state. Therefore, in the printer 1 according to the present embodiment, the switching section 100 can be displaced into the third state in accordance with displacement of the door 17 from the closed state to the opened state, with a simple configuration of only the biasing section.

In this way, the engaging section of the present embodiment is the slider 110, and is linearly movable in a state of being engaged with the protrusion 103, so that a moving region of the engagement section can be narrowed. Therefore, with such a configuration, it is possible to suppress an increase in the size of the apparatus.

As described above, in the printer 1 of the present embodiment, in FIGS. 2 and 3, the tip end 102 on the +Z direction side, which is the other end side in the transverse direction of the switching section 100, is positioned further on the +X direction side than is the switching section pivot shaft 101. Therefore, the switching section 100 adopts the second state shown in FIG. 3 as its basic posture due to its own weight. In other words, the printer 1 of the present embodiment is configured such that, assuming that the direction in which the switching section 100 is displaced from the first state to the second state is a first direction and that the door 17 is positioned in the closed state, a force due to its own weight is applied to the switching section 100 so as to pivot the switching section 100 toward the first direction side, with the switching section pivot shaft 101 as a reference.

When the door 17 is positioned in the closed state, and a force due to its own weight is applied to the switching section 100 so as to pivot the switching section 100 toward the first direction side with reference to the switching section pivot shaft 101, the feeding transport path T0 is less likely to open when the door 17 is positioned in the opened state. However, with the above-described configuration, when the door 17 is positioned in the opened state, the switching section 100 can be displaced into the third state, in which the feeding transport path T0 is opened, in interlock with the displacement of the door. For this reason, the feeding transport path T0 is opened by opening the door 17, and it is possible to easily remove medium P that has failed to be transported in the feeding transport path T0.

In addition, as described above, in the printer 1 of the present embodiment, the door 17 has the door pivot shaft 170 along the Z axis direction, which is a direction intersecting the width direction. That is, the directions of the door pivot shaft 170 and the switching section pivot shaft 101 are different. When the directions of the door pivot shaft 170 and the switching section pivot shaft 101 are different, it is generally difficult to integrally displace the door 17 and the switching section 100. In the configuration in which the directions of the door pivot shaft 170 and the switching section pivot shaft 101 are the same, then when the door 17 is closed, the door 17 can abut on the entire switching section 100 in the width direction at the same timing. This is because, in contrast, in a configuration in which the directions of the door pivot shaft 170 and the switching section pivot shaft 101 are different from each other, the side surface of the switching section 100 and the door 17 contact each other. However, as described above, in the printer 1 of the present embodiment, since the protrusion 103 is movable along with the displacement of the door 17 and the switching section 100 pivots about the switching section pivot shaft 101 by the movement of the protrusion 103, the door 17 and the switching section 100 can be integrally displaced.

As described above, in the printer 1 according to the present embodiment, the door 17 configures at least a portion of the inversion path T3 when the door 17 is positioned in the closed state. The door 17 may constitute at least a portion of the inversion path T3 and also at least a portion of a transport path other than the inversion path T3. To be specific, the door 17 of the present embodiment forms a portion of the inversion path T3 and also forms a portion of the switchback path T2 or the manual feed path. With such a configuration, it is possible to reduce the number of components of the transport path, and to reduce the cost and size of the apparatus. However, the transport path other than the inversion path T3 is not limited to the switchback path T2 or to the manual feed path.

Note that, as shown in FIGS. 2 and 3, the inversion path T3 and the feeding transport path T0 are disposed at positions at which at least a portion thereof overlaps with each other in the Z axis direction, that is, the gravity direction. Therefore, in the printer 1 of the present embodiment, it is possible to reduce the size of the apparatus. In addition, in a case where the inversion path T3 and the feeding transport path T0 are disposed at a position at which at least a portion thereof overlaps with each other in the gravity direction, in general, a region in which the switching section 100 covers the feeding transport path T0 is widened, and it is difficult to easily remove the medium P that has failed to be transported in the feeding transport path T0. However, as described above, in the printer 1 of the present embodiment, the switching section 100 is displaceable to the third state in which the feeding transport path T0 is opened up when the door 17 is in the opened state. For this reason, the feeding transport path T0 is opened by opening the door 17, and it is possible to easily remove medium P that has failed to be transported in the feeding transport path T0. In other words, "at least a portion overlaps in the gravity direction" means that least a portion overlaps when viewed from the horizontal direction. For example, in FIG. 2, at least a portion overlaps in the range S1.

As shown in FIG. 1, the printer 1 of the present embodiment includes the first medium cassette 3 as a medium accommodation section that contains a medium P, the first transport path is the inversion path T3 that inverts a recorded medium on which recording has been performed by the line head 51 and that transports the medium to the recording transport path T1, the second transport path is the feeding transport path T0 that feeds the medium P contained in the first medium cassette 3 to the recording transport path T1, and the third transport path is the recording transport path T1 that includes the recording position of the line head 51. For this reason, in the printer 1 according to the present embodiment, the inversion path T3 and the feeding transport path T0 are opened by opening the door 17, and it is possible to easily remove the medium P that has failed to be transported in the inversion path T3 and the feeding transport path T0.

In addition, as shown in FIG. 1, in the printer 1 of the present embodiment, the inversion path T3 and the first medium cassette 3 are disposed at a position at which at least a portion thereof overlaps in the gravity direction. Therefore, the printer 1 of the present embodiment can be reduced in size.

The present disclosure is not limited to the embodiments described above, and various modifications are possible within the scope of the disclosure described in the claims, and it goes without saying that such modifications are also included within the scope of the present disclosure. For example, the present disclosure is not limited to a printer and, as long as it includes a door 17 and a transport path having a merging point P1 as described above, may be applied to a medium transport apparatus in a scanner, an intermediate section provided between various apparatuses, or a medium transport apparatus in a finisher.

What is claimed is:

1. A medium transport apparatus comprising:

a transport path that transports a medium, the transport path including a first transport path, a second transport path, and a third transport path formed by the first transport path and the second transport path merging at a merging point;

a door that is displaceable between a closed state in which the door forms at least a portion of the first transport path and an opened state in which at least a portion of the first transport path is opened; and a switching section that is arranged at the merging point and that is, while the door is in the closed state, displaceable between a first state in which the second transport path is opened and a second state in which the first transport path is opened, wherein when the door is in the opened state, the switching section is displaced to a third state in which at least a portion of the second transport path is opened by the movement of the door moving to the opened state.

2. The medium transport apparatus according to claim 1, wherein the switching section includes an interlocking section configured to move in conjunction with displacement of the door, and a switching section pivot shaft extending along a width direction that intersects a transport direction of the medium in the transport path, the door is configured to move the interlocking section with displacement between the closed state and the opened state, and the switching section pivots about the switching section pivot shaft by movement of the interlocking section accompanying displacement of the door.

3. The medium transport apparatus according to claim 2, further comprising:

an engagement section that is displaceable in a state of being engaged with the interlocking section and a biasing section configured to, while the door is in the closed state, bias the engagement section such that the switching section is biased in a direction in which the switching section is displaced to the third state.

4. The medium transport apparatus according to claim 3, wherein the engagement section is linearly movable in a state of being engaged with the interlocking section.

5. The medium transport apparatus according to claim 2, wherein assuming that a direction in which the switching section is displaced from the first state to the second state is a first direction, when the door is in the closed state, a force due to its own weight is applied to the switching section so that the switching section pivots toward the first direction side about the switching section pivot shaft.

6. The medium transport apparatus according to claim 2, wherein the door has a door pivot shaft along a direction intersecting the width direction.

7. The medium transport apparatus according to claim 1, wherein when the door is in the closed state, the door configures at least a portion of the first transport path and configures at least a portion of the transport path other than the first transport path.

8. The medium transport apparatus according to claim 1, wherein the first transport path and the second transport path are disposed at positions at which at least a portion of the first transport path and a portion of the second transport path overlap each other in the gravity direction.

9. A recording apparatus comprising:

the medium transport apparatus according to claim 1 and a recording section that performs recording on the medium.

10. The recording apparatus according to claim 9, further comprising:

a medium accommodation section for containing the medium, wherein the first transport path is an inversion path that inverts a recorded medium on which recording was performed by the recording section and transports the inverted recorded medium to the third transport path, the second transport path is a feeding transport path for feeding the medium accommodated in the medium accommodation section to the third transport path, and the third transport path is a recording transport path including a recording position of the recording section.

11. The recording apparatus according to claim 10, wherein the first transport path and the medium accommodation section are disposed at positions that at least partially overlap in the gravity direction.

12. A medium transport apparatus comprising:

a transport path that transports a medium, the transport path including a first transport path, a second transport path, and a third transport path formed by the first transport path and the second transport path merging at a merging point;

a door that is displaceable between a closed state in which the door forms at least a portion of the first transport path and an opened state in which at least a portion of the first transport path is opened; and a switching section that is arranged at the merging point and that is, while the door is in the closed state, displaceable between a first state in which the second transport path is opened and a second state in which the first transport path is opened, wherein when the door is in the opened state, the switching section is displaced to a third state in which at least a portion of the second transport path is opened, and wherein the switching section includes an interlocking section configured to move in conjunction with displacement of the door, and a switching section pivot shaft extending along a width direction that intersects a transport direction of the medium in the transport path, the door is configured to move the interlocking section with displacement between the closed state and the opened state, and the switching section pivots about the switching section pivot shaft by movement of the interlocking section accompanying displacement of the door.

13. A medium transport apparatus comprising:

a transport path that transports a medium, the transport path including a first transport path, a second transport path, and a third transport path formed by the first transport path and the second transport path merging at a merging point;

a door that is displaceable between a closed state in which the door forms at least a portion of the first transport path and an opened state in which at least a portion of the first transport path is opened;

a medium accommodation section for containing the medium; and a switching section that is arranged at the merging point and that is, while the door is in the closed state, displaceable between a first state in which the second transport path is opened and a second state in which the first transport path is opened, wherein when the door is in the opened state, the switching section is displaced to a third state in which at least a portion of the second transport path is opened, and wherein the first transport path and the medium accommodation section are disposed at positions that at least partially overlap in the gravity direction.

* * * * *